US005269425A

United States Patent [19]

Gomez-Acevedo

[11] Patent Number: 5,269,425

[45] Date of Patent: Dec. 14, 1993

[54] NURSING BOTTLE

[76] Inventor: Humberto Gomez-Acevedo, Rancho Jigüingo No. 25, Prado Coapa, Mexico, D.F. 14350

[21] Appl. No.: 37,090

[22] Filed: Mar. 25, 1993

[51] Int. Cl.[5] ..... A67J 9/00

[52] U.S. Cl. ..... 215/11.1; 215/11.4

[58] Field of Search ..... 215/11.1, 11.4, 11.5

[56] References Cited

U.S. PATENT DOCUMENTS

| | | | |
|---|---|---|---|
| 2,597,483 | 5/1952 | Head, Sr. | 215/11.4 X |
| 3,071,272 | 1/1963 | Doner | 215/11.1 |
| 4,339,046 | 7/1982 | Coen | 215/11.4 X |
| 4,676,387 | 6/1987 | Stephenson et al. . | |
| 4,685,577 | 8/1987 | Chen | 215/11.4 X |
| 4,856,995 | 8/1989 | Wagner | 215/11.1 X |
| 4,971,211 | 11/1990 | Lake | 215/11.1 X |
| 5,176,561 | 1/1993 | Greenberg et al. | 215/11.4 X |

FOREIGN PATENT DOCUMENTS

| | | | |
|---|---|---|---|
| 2169210 | 7/1986 | United Kingdom | 215/11.4 |

*Primary Examiner*—Allan N. Shoap
*Assistant Examiner*—Christopher McDonald
*Attorney, Agent, or Firm*—Frishauf, Holtz, Goodman & Woodward

[57] ABSTRACT

The separate storage of powdered milk or dehydrated foods and water and the admixing of said substances at the time of use is permitted in a nursing bottle by providing a nursing bottle with a partition for dividing the container thereof into two separate compartments, said partition having an intercommunicating opening for intercommunicating said compartments, and a removable plug inserted into said intercommunicating opening by a friction fit, said friction fit having a strength sufficient to keep said plug within said opening under normal conditions but insufficient to maintain said plug within said opening when the liquid contained in one of the compartments is shaken or when one of the compartments is pressed to establish a pressure differential between the two compartments.

8 Claims, 3 Drawing Sheets

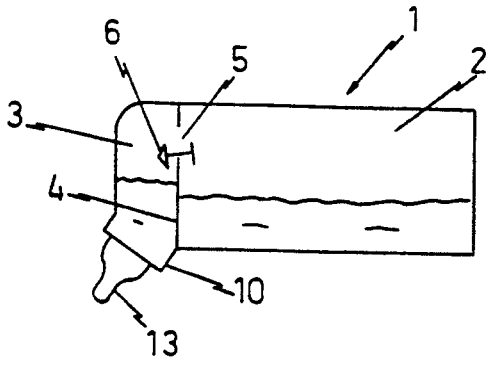
FIG. 3A
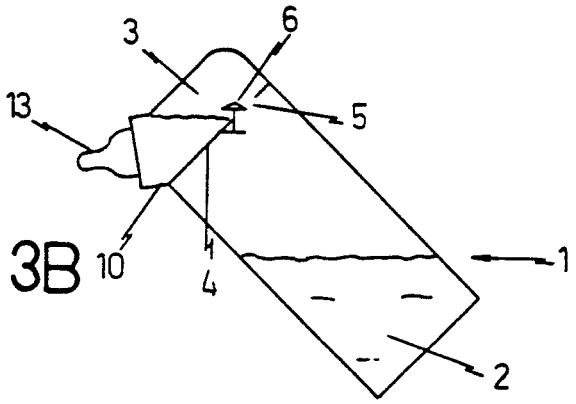
FIG. 3B
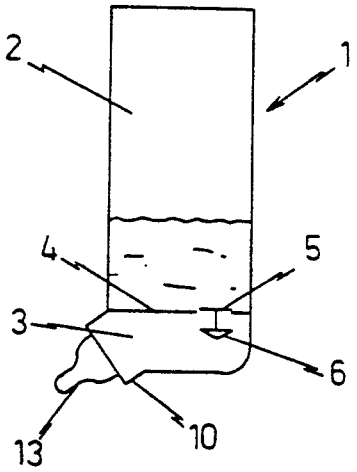
FIG. 3C
FIG. 4A
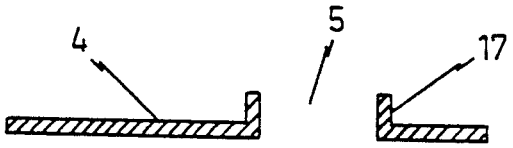
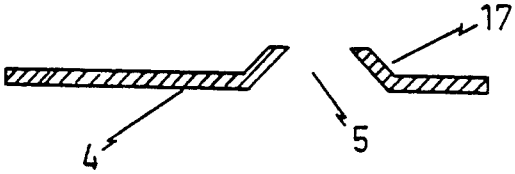
FIG. 4B

NURSING BOTTLE

FIELD OF THE INVENTION

The present invention refers to the technics of intercommunicating the contents of closed compartments in a container for use in the pharmaceutical and food industries and, more particularly, it is related to a nursing bottle which allows the intercommunication of at least two closed compartments to mix the contents thereof without any contact with the outside environment.

BACKGROUND OF THE INVENTION

The effect of pressure on the opening of devices which relieve pressure is broadly known in the prior art, inasmuch as there are a multiplicity of fast opening devices which, upon detecting an increase in the pressure beyond a predetermined limit, which may even be dangerous, open or break in this emergency instances due to the direct effect of the pressure change. Examples of these devices at the industrial level are the safety or relief valves or the rupture discs which are included as safety devices in containers working at high pressures, or at the domestic level the safety valves which are used in pressure kettles and the like.

On the other hand, there is also a large variety of receptacles divided into various compartments which, on opening by means of some external agent, permit the admixing of substances within the receptacle, as is the case of the light sources by chemical reaction which are used in dividing, in which, in order to accomplish the opening of a receptacle which is contained within another receptacle, stresses are applied on the outer flexible surfaces of the walls of the outer receptacle, with which said walls apply a corresponding stress on the outer rigid surface of the wall of the inner receptacle, breaking the same and producing a crack in said wall of the inner receptacle for accomplishing the admixing of the contents of the two receptacles.

There is on the other hand a constant need of admixing products for consumption thereof, such as medicines, food products, reactants, and the like, but in many of these cases, when the mixing of the substances is effected, such as for instance, the admixing of a solute with a solvent, the mixtures are quickly degraded by a plurality of chemical or biological reactions, which considerably shorten the useful life of the solution, whereby at present it is preferred to keep said products (solid and solvent) stored in separate containers to be admixed at the precise time of use. If on the contrary said substances are packaged within a container after admixing the same, it is usually necessary to give to the resulting solution a special treatment such as sterilization or the addition of radioactive isotopes in the case of milk, for instance, or the addition of preservers in the case of food products, or the addition of pH regulators or buffers in the case of reactants.

The need of a practical fast opening system is critical, for instance, in nursing bottles for feeding babies, in which the normal procedure known in the prior art is to admix the powdered milk with water within the nursing bottle. However, between the moment of preparing the milk and the ingestion thereof a long period of time may pass, in which bacterial colonies may be developed, thus increasing the possibility of causing a gastrointestinal infection to the baby consuming said mixture. It is for this reason that, when the milk is not to be consumed immediately, it becomes necessary to carry the powdered milk and the water in separate containers, and to admix both substances at the precise time of consumption by the baby, which practice shows the important drawback that there is the possibility of introducing contaminant particles within the nursing bottle, originating from the environment or from the natural manipulation which is effected for admixing both substances.

The nursing bottles known in the prior art, on the other hand, have the drawback that the longitudinal axis of the nursing bottle has to be located in a neutral position or with a negative slope, in order for the milk to come out through the sucker device, thus forcing the baby to adopt a position in which his head in a nearly horizontal direction, and to constantly hold the nursing bottle in the above said position in order to ingest the liquid, this increasing the incidence of middle ear infections and bronchial inhaling, because of the position that the Eustaquio tubes and the epiglottis respectively adopt.

U.S. Pat. No. 4,676,387 patented to Jim D. Stephenson on Jun. 30, 1987, describes and claims a nursing bottle comprising a body having a lower cylindrical section and an upper cylindrical section of the same diameter, the body of the bottle having a configuration including an angle between both above cylindrical sections, which is spaced from the top end of the bottle in an intermediate position between the top end and the bottom end thereof. Regardless of the fact that said nursing bottle solves the problems caused by the position that the baby is forced to adopt with all other prior art nursing bottles which are formed with a single cylindrical body, it nevertheless presents the same problems as conventional nursing bottles, inasmuch as it is necessary to mix the solute and the solvent previously or to handle said solute and solvent in a separate manner until shortly before the time of use.

In view of the above, it may be concluded that none of the prior art nursing bottles has fulfilled the purpose of providing and efficient nursing bottle which will avoid the inconvenience of having to handle the solute and the solvent in a separate manner till the moment of use, or of generating strong bacterial proliferation when the mixture is prepared previously, with the consequent increase in the possibility of causing a gastrointestinal infection to the baby consuming said mixture.

OBJECTS OF THE INVENTION

Having in mind the defects of prior art nursing bottles, it is an object of the present invention to provide a nursing bottle capable of containing in separate compartments a solute such as powdered milk and a solvent such as water and which will permit the admixing of said substances shortly before the time of use.

Another object of the present invention is to provide a nursing bottle of the above mentioned character, which will be of a very simple construction and will permit the admixing of the contents thereof by means of a fast, simple and safe operation without contacting the mixture and the system with the outside environment.

It is another object of the present invention to provide a nursing bottle of the character described above, which will permit the intercommunication of its compartments through the disruption of a partition by the application of a force from the outside of the nursing bottle.

Another object of the present invention is to provide a nursing bottle of the above character which will reduce the possibility of proliferation of bacteria in the substances stored, and will therefore reduce the possibility of infection troubles in the babies using the same.

One other object of the present invention is to provide a nursing bottle of the above character, which will allow the accumulation of liquid in the compartment nearer to the sucking nipple thereof and to extract said liquid through said sucking nipple without the need of maintaining the longitudinal axis of the nursing bottle in a negative or zero slope.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments, when read in connection with the accompanying drawings, in which:

FIGS. 3A through 3C are diagrammatic elevational views of the different positions adopted by the nursing bottle of the present invention when in use.

FIGS. 4A and 4B are cross sectional views of two preferred embodiments of the partition, showing the opening provided therein for intercommunicating the two compartments of the nursing bottle.

DETAILED DESCRIPTION

Having now more particular reference to the drawings, there is shown a nursing bottle built in accordance with the present invention and which essentially comprises a container provided with at least two compartments inside thereof, a discharge section in one of said compartments, a sucking nipple at said outlet section, and a sanitary cover for the nipple, said compartments being separated by a wall or partition, although it must be understood that it is possible to have, instead of the two compartments inside the container, at least two containers joined collinearly to each other, in which case the partition will be constituted by a dividing wall or a coincident wall of each container, without thereby departing from the spirit and scope of the invention.

Figure 1:
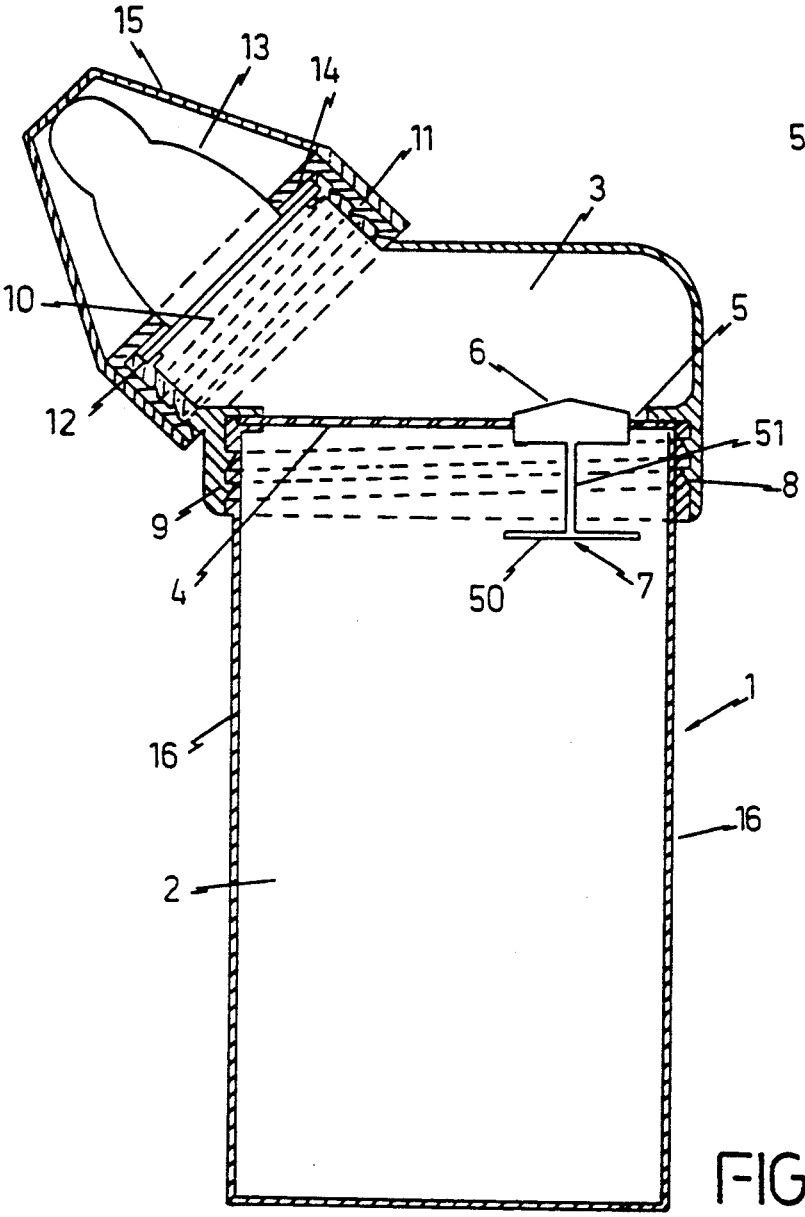
FIG. 1 is a cross sectional elevational view of a nursing bottle built in accordance with an embodiment of the present invention.
Figure 5:
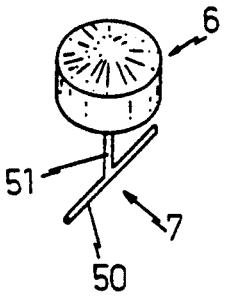
FIG. 5 is a perspective view of the removable plug which is inserted in the opening of the partition of the nursing bottle built in accordance with an embodiment of the present invention.

Having now more particular reference to FIG. 1, there is shown a nursing bottle 1 built in accordance with a specific embodiment of the present invention and which generally comprises, taking into consideration the position of FIG. 1, a container system with at least two compartments 2 and 3 located adjacent and collinearly to each other in a vertical position, said compartments comprising a lower compartment 2 of larger capacity and an upper compartment 3 of lower capacity, although under the understanding that both compartments could be of the same capacity, or the upper compartment 3 could be of the larger capacity; a partition 4 between compartments 2 and 3, which comprises an opening 5 passing therethrough preferably an accentric opening of a predetermined size suitable to insert a removable plug 6 therein, which plug has an inverted T-like extension 7 on its lower surface as shown in FIG. 5 of the drawings, which extension prevents the free passage of the plug 6 from one compartment to the other compartment; coupling means 8 located in the upper portion of said compartment 2; complementary coupling means 9 located in the lower portion of said compartment 3; an outlet section 10 located in the upper portion of compartment 3, said outlet section forming an angle different from zero degrees with respect to the vertical longitudinal axis of the compartments system; and a sucking nipple 13 coupled in said outlet section 10 to allow the liquid flow out from the nursing bottle 1.

The partition 4, as more clearly shown in FIG. 4A, may include a vertical wall or rim 17 located around the opening 5 and extending upwardly thereof into the upper compartment 3; said rim 17, however, may also have a frustoconical shape as shown in FIG. 4B, with any desired dimension and inclination, to prevent the mixture from returning to the lower compartment 2 when the system is in a vertical position.

The partition 4 may constitute an integral portion of the upper compartment 3 or an integral portion of the lower compartment 2, or may be an independent piece located between the two compartments, on the plane where both compartments meet.

As to its function, the nursing bottle 1 of the present invention permits to store and carry different separate substances (solute and solvent), such as powdered milk and water, dehydrated foods and water, or other separate substances of this kind, said substances being kept separate until the very moment they are going to be consumed, at which time said substances can be mixed together at will.

The assembling operation of the nursing bottle of the present invention in order to produce a ready-to-use device, generally comprises introducing water in the lower compartment 2, either using the opening 5 when the partition 4 is integral with said lower compartment 2 or introducing water directly into the lower compartment 2 if said partition 4 is an independent piece located over said lower compartment 2 or is integral with the upper compartment 3; then placing the removable plug 6 in the opening 5 to form an hermetic closure between both compartments 2 and 3 when they are coupled to each other; coupling both compartments 2 and 3 by using the coupling means 8 of the lower compartment 2 and the coupling means 9 of the upper compartment 3; and once both compartments are coupled, introducing the powdered milk or the dehydrated food into the upper compartment 3 in a sufficient amount, through the outlet section 10 which is located forming an angle different from zero degrees with respect to the vertical longitudinal axis of the compartments system or main container.

The outlet section 10 comprises a coupling device 11, preferably a screw thread, by means of which a cap 12 is coupled to the outlet section 10, said cap 12 having a centrally arranged bore to fasten the sucking nipple 13, which cap permits the sucking nipple to pass through the central bore thereof and to press the lower circumferential rim 14 of the sucking nipple 13 against the outlet section 10, closing hermetically said outlet section 10. Finally, a cover 15 is arranged to completely cover the sucking nipple 13 in order to protect it against impurities.

Once both compartments have been independently filled as described above and the nursing bottle has been properly assembled as also indicated above, the said nursing bottle 1 can be carried without the risk of contamination through contact of the mixture with the environment and also without the risk of bacterial proliferation due to storage of a previously prepared mixture in the nursing bottle for a predetermined time, since as mentioned above, the nursing bottle of the present invention permits to carry different substances (solute and solvent) completely separate from each other, up to the time on which a mixture of said substances is to be consumed.

For the purpose of preparing the nursing bottle of the present invention for use by the consumer baby or the like, by the admixing of the contents of both compartments 2 and 3, it is possible to remove the removable plug 6 from the opening 5 by energetically shaking the nursing bottle in the direction of its longitudinal axis, in order to produce an impact pressure generated by the inertia and momentum of the liquid contained in compartment 2, when said liquid impacts against the removable plug 6, thus forcing said removable plug 6 out of said opening 5, without however removing it completely therefrom, due the configuration of the inverted T projection 7 which retains said plug 6 against the opening 5 but allows however the admixing of the contents of both compartments 2 and 3 by intercommunicating said compartments. When the nursing bottle is manufactured of a flexible material, it is also possible to remove the removable plug 6 from the opening 5 by pressing the walls 16 of the compartment 2, thus producing an increase in the internal pressure of said compartment 2 causing a pressure differential between the faces of the removable plug 6, inasmuch as the pressure in the compartment 2 will be higher than the pressure in the compartment 3, by which the expulsion of said removable plug 6 is effected in a direction towards the compartment 3 due the difference of pressures in the compartments 2 and 3. The plug 6 can also be removed from the opening 5 through the use of a combination of both above described procedures, that is, by both shaking the nursing bottle and pressing the walls of compartment 2 at the same time.

The extension 7 of removable plug 6, which has the form of an inverted "T" is directed towards the compartment 2 and must comply with the condition that its transverse bar 50, which is attached to the post 51 at the far end thereof, is of a larger length than the diameter of the opening 5, so that when said removable plug 6 is removed from said opening 5, said extension 7 does not permit said removable plug 6 to be released into compartment 3, because said extension 7 will remain anchored to said opening 5 by the transverse bar 50.

In addition to the advantages of permitting the storage and carrying of a solvent such as powdered milk or dehydrated foods and a solute such as water in a separate manner, and the admixing of said substances only at the time use for consumption thereof, without contacting with the outside environment, one other important advantage resides on the fact that the outlet section 10 located in the upper compartment 3 is at an angle different from zero degrees relating the longitudinal axis of the compartments system, said angle being selected in accordance with the requirements of the user, which means that the nursing bottle could be manufactured of flexible and elastic material in order to adopt different angles, or adopt a predetermined angle if the nursing bottle is manufactured of rigid materials. On the other hand, as the outlet section 10 where the sucking nipple 13 is coupled has an angle different from zero degrees, it avoids the user to be forced to place his head in a horizontal or nearly horizontal position as it occurs at present when using a conventional nursing bottle, whereby further to the comfort provided by the nursing bottle of the present invention, it is also possible to decrease the possibility that the liquid ingested may drain towards the Eustaquio tubes or to the bronchial tubes, thus consequently reducing the incidence of middle ear infections and bronchial aspiration, due to the position the outlet section 10, which further favors the fact that the air contained in the nursing bottle 1 of the present invention, will tend to move away from the sucking nipple 13 when the baby is sucking, thus reducing the swallowing of air and the consequent incidence of colics.

Figure 2:
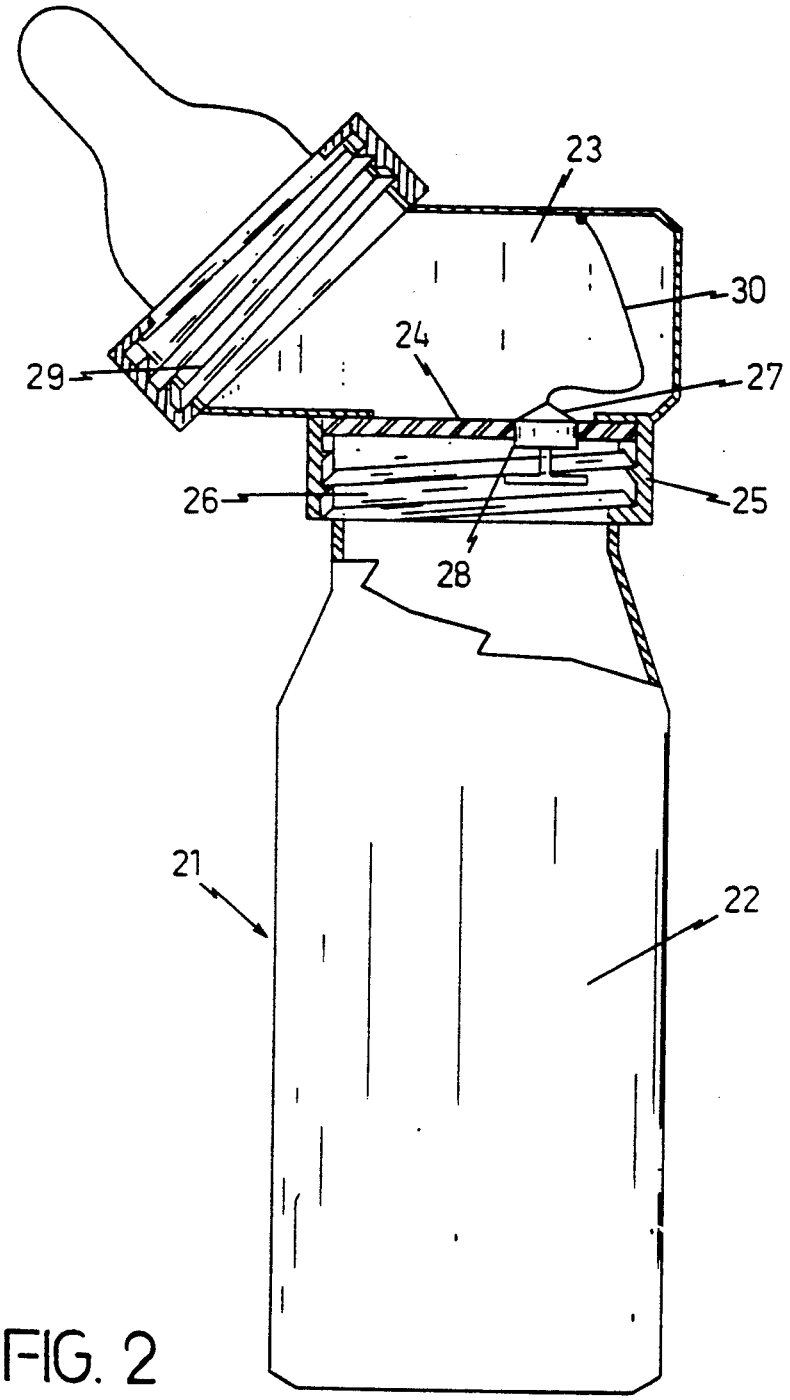
FIG. 2 is a cross sectional elevational view of a nursing bottle built in accordance with another embodiment of the present invention.

In FIG. 2, there is shown a nursing bottle 21 built in accordance with another specific embodiment of the present invention, wherein the upper compartment 23 is wider and is eccentrically located with respect to the lower compartment 22 which has a conventional size and shape such as the nursing bottles of the prior art. Both compartments 22 and 23 are coupled through an internally threaded cylindrical section 25 located on the lower portion of compartment 23 and an externally threaded neck 26 located on the upper portion of the compartment 22.

In this embodiment, the cylindrical section 25 projects downwardly from the compartment 23 and threadably couples with the neck of compartment 22. The removable plug 27 which is placed in the opening 28 of the partition 24, comprises in its upper end situated within said compartment 23, a filament 30 interconnected between said upper end and any one of the walls of said compartment 23, preferably the wall opposite to the partition 24, said filament 30 having as its main purpose keeping said plug 27 within said compartment 23, to avoid any accidental loss thereof.

FIGS. 3A to 3C schematically show the preferred positions in which it is possible to place the nursing bottle of the present invention in use, once the removable plug 6 has been removed from the partition 4.

FIG. 3A shows a position of use in which the liquid previously mixed is extracted easily from the nursing bottle without the baby's need to put his head in a position near to the horizontal plane or with a negative slope with respect to the longitudinal axis of the nursing bottle 1, taking advantage of the directional position of the outlet section 10 and of the sucking nipple 13 at an angle different from zero degrees with respect to the longitudinal axis of the nursing bottle 1.

FIG. 3B shows another position in which the nursing bottle is able to accumulate a predetermined amount of liquid in the compartment 3, thus permitting the extraction of said predetermined amount thereof through the sucking nipple 13 without the need of placing the nursing bottle with its longitudinal axis on a negative or horizontal slope.

FIG. 3C, in turn, shows another position in which the liquid within the nursing bottle 1 flows continuously to the exterior through the sucking nipple 13, without the need for the user to place his head in an horizontal position.

In order to increase the capacity of compartment 3 during the extraction of the liquid mixture, it is convenient to locate the opening 5 of the partition 4 nearer to the end of the partition which is farther away from the position of the outlet section 10, as shown in FIGS. 1, 2 and 3A to 3C. On the other hand, if the partition 4 is an independent part of the compartment system, once the mixture of solute and solvent is produced, said partition 4 might be removed from the nursing bottle 1 by disengaging both compartments 2 and 3, in order to fully intercommunicate both compartment 3 and 4, once said partition is removed, so as to use the nursing bottle without any obstruction to the extraction of the liquid mixture.

As it will be apparent to any one skilled in the art, the compartments 2 and 3 may be also used to contain different substances which can be consumed in a separate manner without the necessity of mixing them, or said compartments may be also used to store in one of said compartments a temporarily cold or hot liquid, for which selected compartment without appreciably altering the conditions of the contents of the other compartment.

As it will be clearly apparent from the above, the construction of the nursing bottle is very simple and economical, and it must be understood that the embodiments of the invention described above are merely illustrative but not limitative of the present invention, because the nursing bottle may be modified in the details thereof, such as for instance: arranging the outlet section at a different slope; providing the nursing bottle with more than two adjacent compartments; using individual containers separated by a common or coincident wall which will serve as the partition; coupling the compartments or containers by pressure rather than by means of threads; using a removable plug connected by a filament to the cover of the outlet section; modifying the location of the removable plug in any place of the surface of the partition; providing the lower compartment with an upper section arranged at an angle with respect to the remainder of the body thereof; providing the upper compartment with an eccentric outlet section with respect to the body thereof, directing the extension of the removable plug which has the form of an inverted "T" towards the upper compartment, and the like.

Although certain specific embodiments of the invention have been shown and described above, it is to be understood that many modification thereof are possible. The present invention, therefore, is not to be restricted except insofar as is necessitated by the prior art and by the spirit of the appended claims.

What is claimed is:

1. A nursing bottle which comprises a container, an outlet section at the upper end of said container, a cap for closing said outlet section, said cap having a central opening, a sucking nipple having a rim, said sucking nipple being arranged in said cap so that a sucking section thereof projects outwardly of the outlet section and said rim remains pressed between said cap and an outlet end of said outlet section, partition means arranged within said container for dividing said container into at least two compartments adjacent to each other; an intercommunicating opening in said partition means for intercommunicating adjacent compartments, said opening being provided with a removable plug inserted therein by a friction fit, said friction fit having a strength sufficient to keep said removable plug within said intercommunicating opening under normal conditions but insufficient to prevent removal of said plug from said intercommunicating opening when a force is applied on said plug from outside of said container, and stop means for maintaining said removable plug within one of said compartments upon release of said plug from said intercommunicating opening.

2. A nursing bottle according to claim 1 wherein said at least two compartments comprise a lower compartment and an upper compartment within said container, said outlet section being arranged at the upper end of the upper compartment and forming an angle different from zero degrees with respect to the longitudinal axis of said container.

3. A nursing bottle according to claim 2 wherein said upper compartment comprises a removable compartment separable from said lower compartment, and further comprising compartment removably interengaging said compartments to each other for forming said container, said partition means being formed by a bottom of said upper removable compartment.

4. A nursing bottle according to claim 2 wherein said upper compartment comprises a removable compartment separable from said Lower compartment, further comprises compartment coupling means for removably interengaging said compartments to each other for forming said container, said partition means being formed by a top of said Lower compartment.

5. A nursing bottle according to claim 2 wherein said upper compartment comprising a removable compartment separable from said lower compartment, further comprising compartment coupling means for removably interengaging said compartments to each other for forming said container, said partition means comprising a removable partition engaged to said container between said upper and lower compartments by said compartment coupling means.

6. A nursing bottle according to claim 1 wherein said stop means for maintaining said removable plug within one of said compartments upon release of said plug from said intercommunicating opening comprises an extension having an inverted T shape and extending from one of the faces of said plug, a transverse bar of said inverted T shape extension having a length larger than the diameter of said intercommunicating opening of the partition means to serve as a stop for said removable plug.

7. A nursing bottle according to claim 1 wherein said stop means for maintaining said removable plug within one of said compartments upon release of said plug from said intercommunicating opening comprises a filament, one end of which is attached to said plug and another end of which is attached to an interior surface of said container.

8. A nursing bottle as in claim 1 wherein the partition means comprises at least one partition.

* * * * *